United States Patent [19]

Corbin

[11] 4,099,534

[45] Jul. 11, 1978

[54] VAN TOP TENT

[76] Inventor: John R. Corbin, 404 Garwood Dr., Cherry Hill, N.J. 08034

[21] Appl. No.: 769,391

[22] Filed: Feb. 16, 1977

[51] Int. Cl.[2] ..... A45F 1/16; B60P 3/34

[52] U.S. Cl. ..... 135/4 A; 5/119; 296/23 MC

[58] Field of Search ..... 135/1 A, 3 A, 4 A; 296/23 MC, 23 A; 5/119

[56] References Cited

U.S. PATENT DOCUMENTS

| | | | |
|---|---|---|---|
| 2,811,725 | 11/1957 | Ceuce | 135/4 A X |
| 2,870,774 | 1/1959 | Blosser | 135/1 A |
| 2,930,051 | 3/1960 | Kampmeier | 135/1 A X |

FOREIGN PATENT DOCUMENTS

| | | | |
|---|---|---|---|
| 625,472 | 8/1961 | Canada | 135/1 A |

*Primary Examiner*—Werner H. Schroeder
*Assistant Examiner*—Conrad L. Berman
*Attorney, Agent, or Firm*—Duffield and Lehrer

[57] ABSTRACT

A tent and storage compartment therefor are mounted on the top of a van or similar vehicle. The storage compartment comprises a shallow box of approximately the same width as the van but with a length somewhat less than the length thereof and includes a base and a top hinged to the base. A pair of poles having a length approximately equal to the width of the compartment are pivotally connected to the top adjacent each front corner and rest in the front corners of the base to hold the top open. Right and left side support poles are pivotally connected to the front corners of the base and extend outwardly away from the van. The side support poles are jointed together at the other ends thereof by a connecting pole. Cables are connected between the top and the remote ends of the side poles to support the side poles in a horizontal position. Appropriately shaped tent material covers and is suspended from the cables and poles to complete the tent.

7 Claims, 7 Drawing Figures

VAN TOP TENT

BACKGROUND OF THE INVENTION

The present invention is directed toward a van top tent and more particularly toward a van top tent of the suspension type which includes no vertical support poles.

In recent years, camping has become a popular recreation. One of the most annoying problems with camping, however, is having to set up and take down the tent which in many cases is also a relatively difficult process. In addition, most tents when taken down and folded are relatively heavy and bulky and are difficult to transport.

Attempts have been made to make the transportation of tents easier. In this regard, several attempts have also been made to combine a tent with a recreational vehicle such as a van. For example, it has been recognized that a tent could be contained in a box mounted on top of the van. Even further, several proposed prior art systems attempt to utilize the van as part of the tent walls to simplify the tent structure. One such system is shown, for example, in U.S. Pat. No. 2,930,051.

Unfortunately, none of the prior art systems known to applicant have proven to be satisfactory. They are all relatively complex and are, therefore, relatively difficult to assemble and disassemble. Furthermore, because of their complexity, the prior art systems are relatively expensive to manufacture. Even further, all known prior systems require several detachable parts which can be easily lost or forgotten.

SUMMARY OF THE INVENTION

The present invention overcomes substantially all of the problems of the prior art and includes a tent and storage compartment therefor mounted on the top of a van or similar vehicle. The storage compartment comprises a shallow box of approximately the same width as the van but with a length somewhat less than the length thereof and includes a base and a top hinged to the base. A pair of poles having a length approximately equal to the width of the compartment are pivotally connected to the top adjacent each front corner and rest in the front corners of the base to hold the top open. Right and left side support poles are pivotally connected to the front corners of the base and extend outwardly away from the van. The side support poles are joined together at the other ends thereof by a connecting pole. Cables are connected between the top and the remote ends of the side poles to support the side poles in a horizontal position. Appropriately shaped tent material covers and is suspended from the cables and poles to complete the tent.

BRIEF DESCRIPTION OF THE DRAWINGS

For the purpose of illustrating the present invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENT

Figure 1:
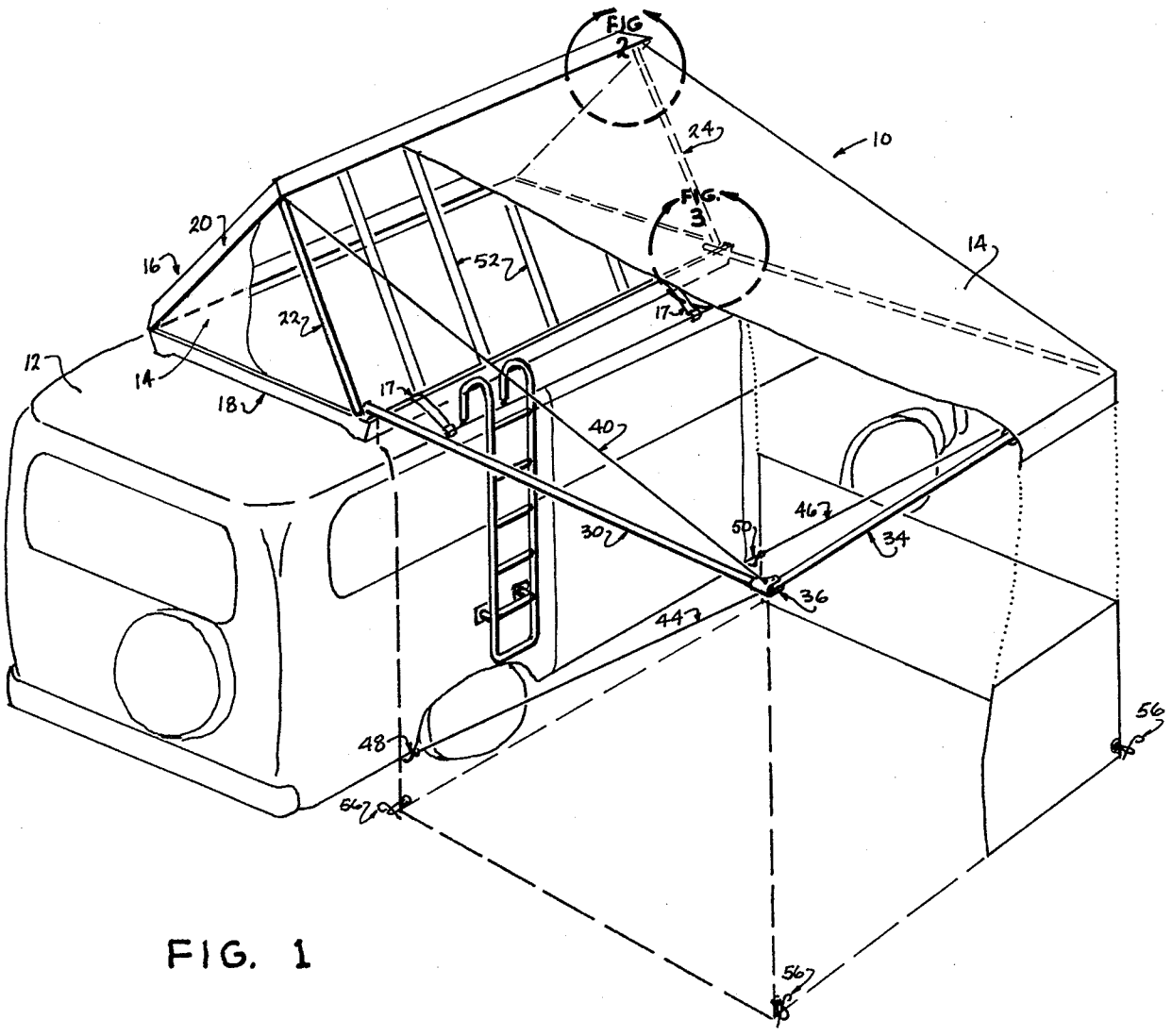
FIG. 1 is a perspective view of a van top tent constructed in accordance with the principles of the present invention with parts thereof broken away to show the details of the invention.

Referring now to the drawings in detail wherein like reference numerals have been used throughout the various figures. to identify similar elements, there is shown in FIG. 1 a perspective view of a van top tent constructed in accordance with the principles of the present invention and designated generally at 10. The tent 10 is shown mounted on top of a van 12. It should be noted that this is by way of example only and that the tent could be readily adapted for use with various other types of vehicles. For clarity and ease of description, part of the tent fabric 14 has been shown broken away in FIG. 1 and has been eliminated in the several other figures.

The van top tent 10 is comprised of a shallow boxlike container 16 having a base 18 and a top 20. Container 16 is mounted on the top of the van 12 by use of straps 17 and has a width which is substantially equal to the width of the top of the van. However, the length of the container 16 is somewhat less than the length of the van. This allows the front door of the van to be opened or closed without interference with the tent when it is in its open position.

Figure 4:
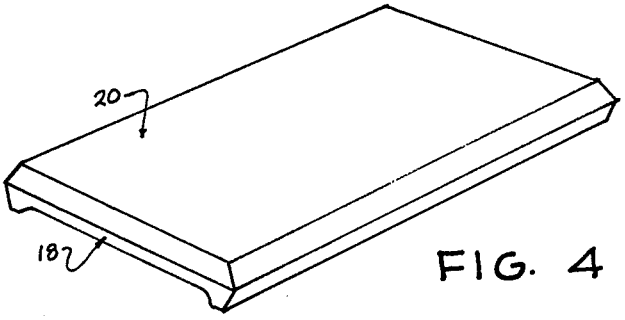
FIG. 4 is a perspective view of the tent housing in its closed position with the entire tent contained therein.

Container 16 service two primary functions. Firstly, all of the remaining parts of the tent described below fit neatly within the interior of the container 16. The closed container with all of the tent components contained therein is shown in FIG. 4. As importantly, however, the container 16, as shown in FIG. 1, functions as part of the tent itself when the same is in its fully open position.

While the container 16 shown in the drawings is comprised entirely of substantially rigid material such as fiberglass or the like, other embodiments are also possible. For example, a frame could be constructed of rigid solid or tubular rods and the frame could then be covered with a flexible fabric material or the like. It is also possible to construct the roof of the van as a container. In this regard, a panel of the roof of the van could be hinged to the remaining parts of the roof. The hinged panel would function as the top of the container and the remaining parts of the roof having a cavity beneath this panel would function as the base of the container.

Figure 2:
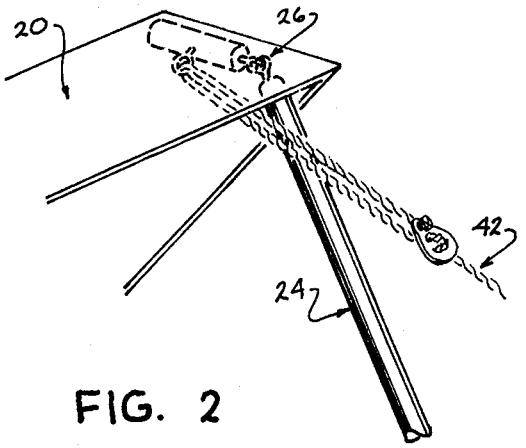
FIG. 2 is a detailed view of the section identified by the arrows 2—2 in FIG. 1.
Figure 3:
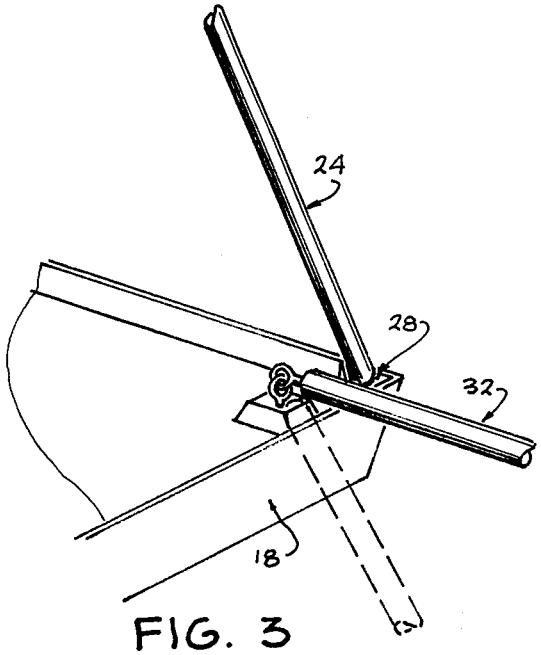
FIG. 3 is a detailed view of the section identified by the arrows 3—3 in FIG. 1.

As shown in FIG. 1, the left or rear sides of the base 18 and the top 20 of the container 16 are hinged together through any suitable means. The top 20 is held in its upright opened position by a pair of poles 22 and 24. These poles are substantially equal in length to the width of the container 16. As shown best in FIG. 2, the top of pole 24 is pivotally connected to the inside front right corner of the top 20 by a hinge or similar device 26. The bottom end of pole 24 is merely rested in place in a pocket 28 located in the inside front right corner of the base 18 (See FIG. 3). In a similar manner, pole 22 is pivotally connected to the inside left front corner of the top 20 and the bottom end of pole 22 rests in a pocket (not shown) located in the inside front left corner of the base 18.

A left support pole 30 extends outwardly in a horizontal position from the front left corner of the base 18 and a similar right support pole 32 extends outwardly in a horizontal position from the front right corner of the base 18. A longitudal extending connecting pole 34 is connected to and extends between the ends of support poles 30 and 32. Preferably, the connecting pole 34 is pivotally connected to the end of one of the support poles such as the left support pole 30 by way of a hinge 36. The other end of connecting pole 34 is connected to the free end of right support pole 32 by use of a releasable connector or similar device 38.

The left and right support poles 30 and 32 and the connecting pole 34 are maintained in a substantially horizontal orientation by cables 40 and 42. Cable 40 extends between the left front corner of top 20 and the pivotal connection between support pole 30 and connecting pole 34. Similarly, cable 42 extends between the right front corner of top 20 and the other end of connecting pole 34 or the free end of support pole 32.

Cables 40 and 42 support the weight of the various poles and the tent fabric to prevent the same from falling below the horizontal position of the poles 30 and 32 and 34. However, to prevent the tent fabric and poles from moving upwardly as a result of winds and other disturbances, a pair of tie-down cables 44 and 46 are also provided. Cable 44 has one end connected to the hinge 36. The other end of cable 44 has a hook 48 connected thereto which is adapted to engage the underside of the van frame. Similarly, cable 46 has one end attached to the free end of pole 32 and has a hook 50 at its other end which is also adapted to engage the underside of the van frame. Preferably, each of the cables 40, 42, 44 and 46 include an adjustment means so that the length thereof can be varied. This is necessary in order to maintain the poles 30, 32, and 34 in a horizontal plane.

As shown in FIG. 1, the tent fabric 14 covers the poles 30, 32 and 34 and the cables 40 and 42. The fabric 14 is essentially suspended from these elements and extends downwardly to the ground. It should be noted that only three main walls are needed for the tent since the side of the van serves as the fourth wall. The tent fabric 14 is releasably secured to the inside peripheral edges of the ends and front of the top 20 by use of a zipper or the like. Similarly, the tent fabric 14 is also releasably secured to the inside edges of the ends of base 18 by use of VELCRO material or the like. The tent enclosure is accordingly comprised of the tent fabric 14 and the top 20. A plurality of ground pegs 56 may be used, if desired, around the peripheral bottom edge of the fabric 14 in order to keep the same straight.

Thus, it can be seen that the top 20 serves not only as a cover for the container 16 but also as part of the tent enclosure and as a support for the tent fabric 14. In addition, the base 18 may include a mattress pad on the bottom thereof so that one or more persons can sleep thereon. If the base 18 is used for sleeping quarters, straps 52 which extend between the top and base of the front edges thereof may be provided to prevent the sleeper from falling off the top of the van.

Figure 5:
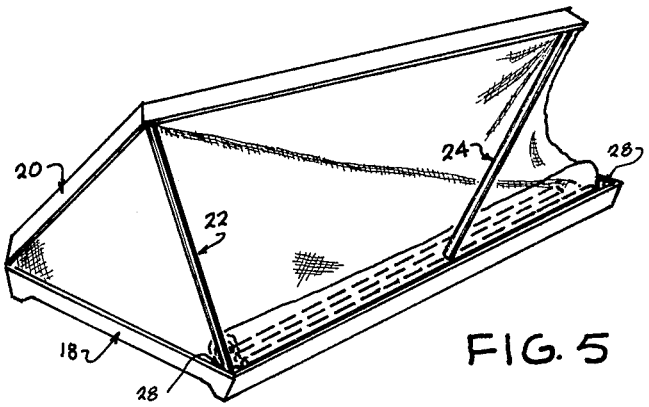
FIG. 5 is a perspective view of the van top tent of the present invention showing the first step in the procedure for erecting the tent.
Figure 6:
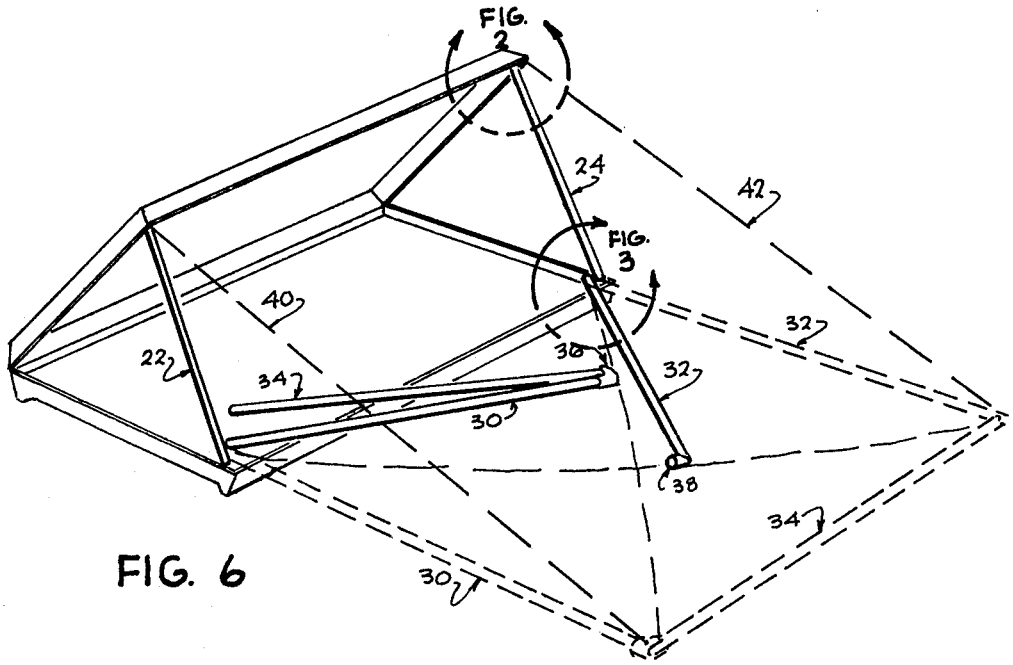
FIG. 6 is a view similar to FIG. 5 showing the further step in the procedure for erecting the tent.

FIGS. 5 and 6 illustrate the manner in which the tent of the present invention is erected. First, the top 20 is opened and the free (lower) end of one of the poles 22 and 24 is grasped. The pole 22, for example, is then used to push the top 12 into its fully opened position. At this point, the lower end of the pole 22 is placed into the pocket 28. The free end of the other of the poles 22 and 24 is then grasped and is similarly used to force the other end of the top 20 upwardly. Support pole 30 is then grasped and swung outwardly so as to be perpendicular to the van. Cable 40 is normally left connected to the top 12 and the end of pole 30 thereby supporting the pole as it is swung out into its open position. Connecting pole 34 and support pole 32 are then simultaneously pivoted about their hinges and are connected to each other through connector 38. Cables 44 and 46 are then connected to the underside of the van frame via hooks 48 and 50.

While the tent fabric is not shown in FIG. 6, it should be noted that the fabric is preferably always left connected to the container 16 so that when the poles are erected as described above, the tent fabric 14 is automatically drawn out from within the container and will automatically fall into its proper place. However, it sometimes may be necessary to make minor adjustments to get the tent fabric to hang properly.

Figure 7:
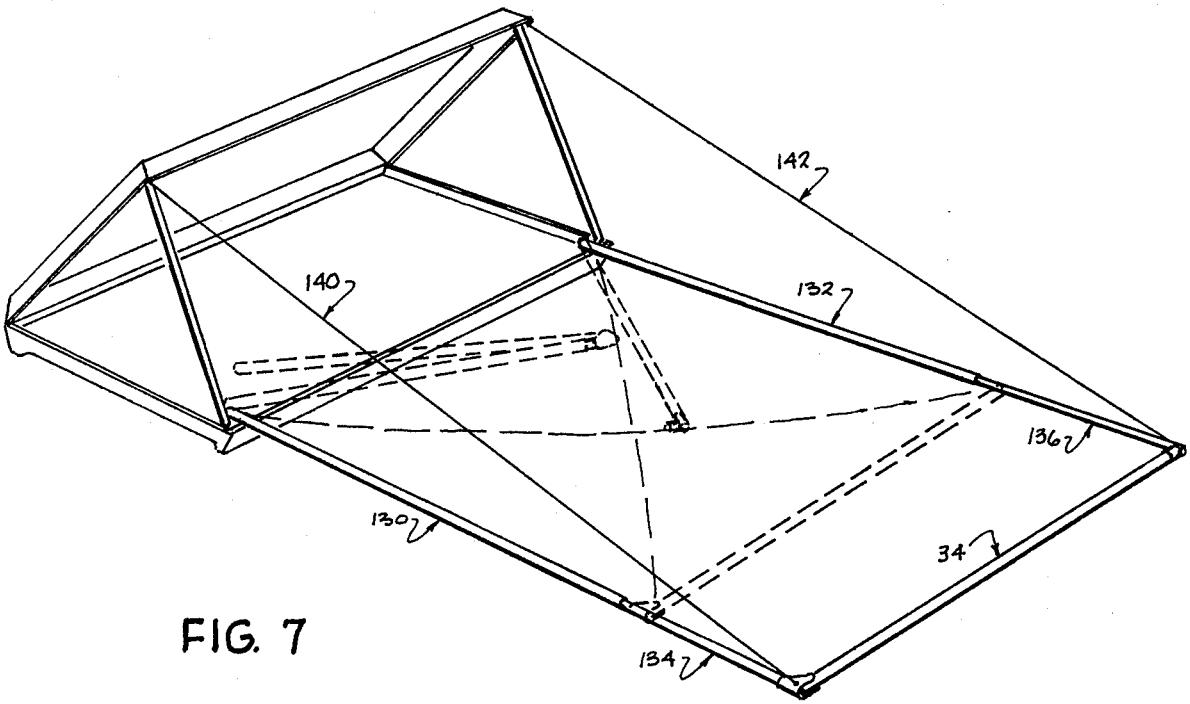
FIG. 7 is a view similar to FIG. 6 showing a slightly modified form of the invention.

FIG. 7 illustrates a modified form of the present invention. The van tent 10 shown in FIG. 7 is substantially identical to the previously described embodiment except for the left and right support poles 30 and 32. These are shown in the embodiment shown in FIG. 7 as elements 130 and 132.

Each of the support poles 130 and 132 is comprised of a pair of poles which are telescoped one within the other. For example, left support pole 130 has a second pole 134 telescoped therein and right support pole 132 has a similar pole 136 telescoped into its end.

With the embodiment shown in FIG. 7, after the poles are erected as described above, poles 134 and 136 can be moved outwardly away from the van so as to increase the size of the tent. The outward extension of the poles 134 and 136 is, of course, controlled by the cables 140 and 142. Locking means, not shown, are also provided for maintaining the poles 134 and 136 in an outwardly extending position. It should be readily apparent that with the embodiment shown in FIG. 7, the tent fabric itself must be somewhat larger. In place of or in addition to the telescoping members 130 and 132, it is also possible to construct the connecting pole 34 so that it also is telescoping. The size and shape of the tent, of course, would have to be adjusted accordingly.

The present invention may be embodied in other specific forms without departing from the spirit or essential attributes thereof and, accordingly, reference should be made to the appended claims, rather than to the foregoing specification as indicating the scope of the invention.

I claim:

1. A van top tent comprising:

a substantially hollow container having a top and a base, means pivotally connecting said top and said base together so that said top can be pivoted relative to said base between a closed and an opened position;

a pair of poles each of which has a first end pivotally connected to said top and a second normally free end, said poles being pivotally movable between a first position within said container to a second position wherein said second ends cooperate with said base to maintain said top in said opened position;

first and second support poles, each of said support poles having a first end pivotally connected to said base and a second end, said support poles being adapted to be pivoted in a substantially horizontal plane between a first position within said container to a second position wherein said support poles extend away from and substantially perpendicular to said container;

a connecting pole having a first end pivotally connected to the second end of said first support pole and connecting means adapted to releasably connect the second end of said connecting pole and the second end of said second support pole;

cable means connected between said top and said supporting poles for maintaining said support and connecting poles in a substantially horizontal plane;

tent fabric connected to said container and adapted to substantially cover and be suspended from said poles, and all of said poles, cable means and tent fabric being adapted to fit within said container when said container is closed.

2. A van top tent as claimed in claim 1 wherein each of said pair of poles is pivotally connected to a different one of the front inside corners of said top.

3. A van top tent as claimed in claim 1 wherein each of said support poles is pivotally connected to a different one of the front inside corners of said base.

4. A van top tent as claimed in claim 1 including further cable means adapted to be connected between said support poles and the bottom of the van frame.

5. A van top tent as claimed in claim 1 wherein said tent fabric is releasably connected to said container.

6. A van top tent as claimed in claim 1 wherein said base includes a mattress pad for providing sleeping space thereon.

7. A van top tent as claimed in claim 1 wherein said first and second support poles include means for adjusting the length thereof.

* * * * *